US007669854B1

(12) United States Patent
Thompson et al.

(10) Patent No.: US 7,669,854 B1
(45) Date of Patent: Mar. 2, 2010

(54) METHOD OF SIMULATING A TRADITIONAL CRAPS GAME WITH BARCODED CARDS AND VIDEO DISPLAY

(75) Inventors: Glenn Thompson, Tulsa, OK (US); Steven Bilby, Sapulpa, OK (US); Steven Loyd, Laquinta, CA (US); Duane D. Jennings, Tulsa, OK (US)

(73) Assignee: Cherokee Nation Enterprises, LLC, Catoosa, OK (US)

( * ) Notice: Subject to any disclaimer, the term of this patent is extended or adjusted under 35 U.S.C. 154(b) by 52 days.

(21) Appl. No.: 11/961,259

(22) Filed: Dec. 20, 2007
(Under 37 CFR 1.47)

(51) Int. Cl.
*A63F 5/00* (2006.01)

(52) U.S. Cl. ..... 273/274; 463/22

(58) Field of Classification Search ..... 463/16, 463/17, 22, 30–32, 37; 273/274, 292
See application file for complete search history.

(56) References Cited

U.S. PATENT DOCUMENTS

| | | | | | |
|---|---|---|---|---|---|
| 59,761 | A * | 11/1866 | McCarthy | 222/36 |
| 4,443,012 | A * | 4/1984 | Makovic et al. | 273/292 |
| 5,770,533 | A * | 6/1998 | Franchi | 463/42 |
| 5,775,993 | A * | 7/1998 | Fentz et al. | 463/17 |
| 5,904,353 | A * | 5/1999 | Aldridge | 273/292 |
| 6,065,752 | A * | 5/2000 | Beltran | 273/274 |
| 6,123,335 | A * | 9/2000 | Adkins | 273/292 |
| 6,179,710 | B1 * | 1/2001 | Sawyer et al. | 463/16 |
| 6,217,447 | B1 * | 4/2001 | Lofink et al. | 463/12 |
| 6,575,834 | B1 * | 6/2003 | Lindo | 463/40 |
| 6,688,597 | B2 * | 2/2004 | Jones | 273/274 |
| 6,886,830 | B1 * | 5/2005 | Boyd | 273/292 |
| 6,913,262 | B2 | 7/2005 | Berman | |
| 7,165,769 | B2 * | 1/2007 | Crenshaw et al. | 273/274 |
| 7,201,656 | B2 * | 4/2007 | Darder | 463/16 |
| 7,374,170 | B2 * | 5/2008 | Grauzer et al. | 273/149 R |
| 7,434,805 | B2 * | 10/2008 | Grauzer et al. | 273/149 R |
| 7,448,626 | B2 * | 11/2008 | Fleckenstein | 273/149 R |
| 2001/0015529 | A1 * | 8/2001 | Allen | 273/292 |
| 2003/0071415 | A1 * | 4/2003 | Huard et al. | 273/274 |

* cited by examiner

*Primary Examiner*—William M Pierce
(74) *Attorney, Agent, or Firm*—Molly D. McKay

(57) ABSTRACT

A method of simulating a traditional craps game experience using a specially designed deck of thirty six (36) playing cards to determine play rather than rolling dice. The deck of playing cards includes one card for each possible roll combination of a pair of dice. The deck is shuffled so that the cards are drawn at random to simulate a player rolling dice. The stickman activates the shuffler to draw a card from the shuffled deck. A bar code on the drawn card is read into a computer via a scanner and the computer then provides a visual representation of a dice roll on the monitors provided on either end of the craps table with the visualization showing the dice landing on the roll combination dictated by the drawn card. The display is activated when the shooter rolls the trackball mouse.

4 Claims, 2 Drawing Sheets

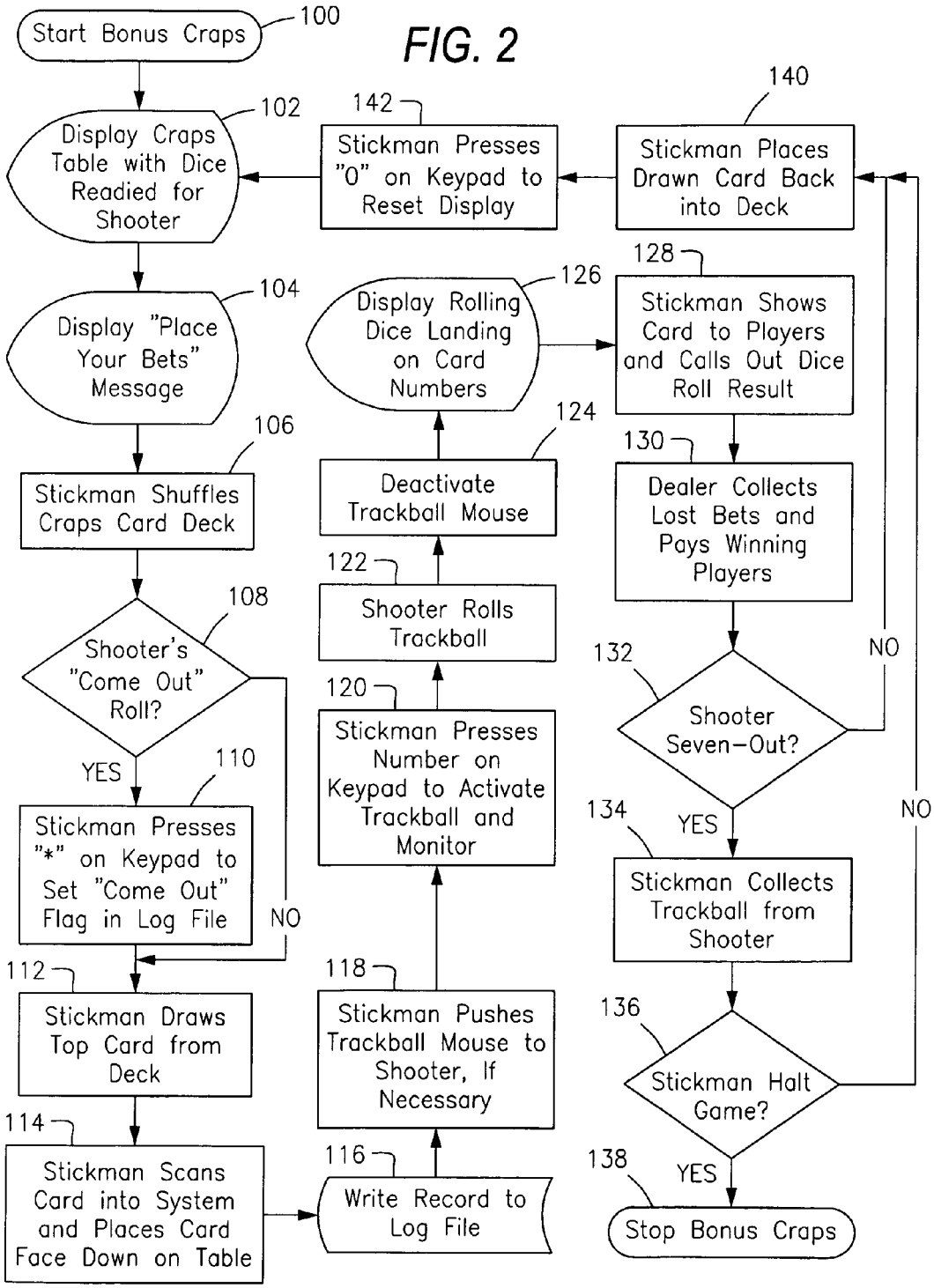
FIG. 2
Start Bonus Craps
100
Display Craps Table with Dice Readied for Shooter
102
Display "Place Your Bets" Message
104
Stickman Shuffles Craps Card Deck
106
Shooter's "Come Out" Roll?
108
YES
NO
Stickman Presses "*" on Keypad to Set "Come Out" Flag in Log File
110
Stickman Draws Top Card from Deck
112
Stickman Scans Card into System and Places Card Face Down on Table
114
Write Record to Log File
116
Stickman Pushes Trackball Mouse to Shooter, If Necessary
118
Stickman Presses Number on Keypad to Activate Trackball and Monitor
120
Shooter Rolls Trackball
122
Deactivate Trackball Mouse
124
Display Rolling Dice Landing on Card Numbers
126
Stickman Shows Card to Players and Calls Out Dice Roll Result
128
Dealer Collects Lost Bets and Pays Winning Players
130
Shooter Seven-Out?
132
NO
YES
Stickman Collects Trackball from Shooter
134
Stickman Halt Game?
136
NO
YES
Stop Bonus Craps
138
Stickman Presses "0" on Keypad to Reset Display
142
Stickman Places Drawn Card Back into Deck
140

METHOD OF SIMULATING A TRADITIONAL CRAPS GAME WITH BARCODED CARDS AND VIDEO DISPLAY

FIELD OF THE INVENTION

The present invention relates to a method of simulating a traditional craps game experience using a specially designed deck of thirty six (36) playing cards to determine play rather than rolling dice. The present invention employs a standard craps table, flat panel LCD or plasma monitors provided at either end of the craps table, a trackball mouse, a card shuffler, a bar code scanner attached to a dedicated computer and a specially designed deck of thirty six (36) cards. Each playing card of the deck has a unique combination of the numbers of the two dice and a barcode containing information about the unique combination of numbers appearing on the card. A card is randomly drawn from the deck and the information about the card is fed into the computer via the bar code scanner. The barcode on the cards is used to control the matching dice roll shown on the monitor displays when a shooter activates the trackball mouse.

DESCRIPTION OF THE RELATED ART

The traditional game of craps is played on a purpose-built table and two dice are used. The player throws the dice so that both dice hit the walls on the opposite end of the table. About 20 players can be accommodated around a craps table, each of whom gets a round of throws or at "shooting" the dice. The player who is shooting the dice is called the "shooter". Several types of bets can be made on the specially designed table. The casino crew consists of a stickman, boxman and two dealers.

The first roll of the dice in a betting round is called the comeout roll. A new game in craps begins with the comeout roll. On the comeout roll, the shooter is trying to establish a point with one of the following numbers: 4, 5, 6, 8, 9, or 10. If the shooter rolls a 7 or 11, the wager is paid off at even money. If the shooter rolls a 2, 3, or 12, then the wager is lost. If the shooter rolls a point number, then it progresses to the next stage where the shooter has to roll the same number again before it hits 7.

A comeout roll can be made only when the previous shooter fails to make a winning roll, i.e. fails to make the point or seven out. After the previous shooter fails, a new game begins with a new shooter. If the current shooter does make his point, the dice are returned to him and he then begins the new comeout roll. This is a continuation of that shooter's roll, although technically, the comeout roll identifies a new game about to begin.

When the shooter fails to make his or her point, the dice are then offered to the player located to the previous shooter's left who will become the new shooter. Thus, play moves in a clockwise fashion around the craps table. The new shooter shoots the dice for the new comeout roll and the game continues in the same manner.

The craps table is divided into three areas: two side areas separated by a center area. Each side area is a mirror image of the other side area and contains the following places that are printed on the table: pass and don't pass line bets, come and don't come bets, odds bets, place bets, and field bets. The center area is shared by both side areas and contains the proposition bets. Several types of bets can be placed on the craps table using the various places that are printed on the table. Each of the various types of bets wins or loses depending on the roll of the dice.

The complete rules for American craps game can be found on various websites by searching for "craps game rules". One of many such websites is ildado.com and another is fastodds.com. These traditional rules for craps game are hereby included by reference.

Gaming regulations sometimes restrict casinos to only games that employ cards and do not allow the casinos to use games that employ dice. However, casinos that are thus restricted still would like to be able to provide a craps game experience to their customers. The present invention allows casinos to provide such an experience within their gaming restrictions. Specifically, the present invention substitutes a special deck of cards for the dice that are employed in a traditional craps game.

SUMMARY OF THE INVENTION

The present invention provides casino guests with an authentic craps like gaming experience using a standard craps table, flat panel LCD or plasma monitors provided at either end of the craps table, a trackball mouse, a card shuffler, a specially designed deck of thirty six (36) cards, a bar code scanner and a dedicated computer located under the craps table that is functionally connected to the monitors, trackballs, scanner and keypad.

The present method simulates a traditional craps game by using the specially designed deck of thirty six (36) playing cards to determine play rather than rolling dice. The specially designed deck of thirty six (36) playing cards includes one card for each possible roll combination of a pair of dice. Each playing card of the deck has a unique combination of the numbers of the two dice and a barcode containing information about the unique combination of numbers appearing on the card. The barcode on the cards is used to control the matching dice roll displayed on the monitors when a shooter activates the display by rolling the trackball mouse. The computer and monitors display a craps table and 3 dimensional animated rolls of the dice. The barcode contains computer readable information that allows a computer to receive information via a bar code scanner about the roll combination appearing on the card.

The playing cards are first shuffled so that the cards are drawn at random to simulate a player rolling dice in a traditional craps game. The stickman causes a random card to be selected and ejected from the shuffler by pressing a button on the shuffler. The stickman will take the ejected card and pass it over a bar code scanner which scans the bar code on the card and transmits the information to a computer located under the craps table about the dice roll combination appearing on the ejected card, and places the card face down on the table. The shooter simulates rolling dice by instead rolling a trackball mouse which activates the display. The computer then provides a visual representation on the two monitors located at either end of the craps table of a pair of dice being rolled. The computer creates a visual representation of the dice landing with the dice roll combination dictated by the drawn card.

All other aspects of the craps game played according to the present method are the same as when playing a traditional craps game using dice including betting, the craps table layout, etc. Like in a traditional craps game, the boxman, stickman, and dealers control all aspects of the game, including betting, card draw, timing of the shooter simulated dice roll, drop buy-ins, pay propositions bets, and managing table bank. The only modification to the craps game made by the present invention is that the rolling of dice is replaced with the random drawing of a card from the specially designed playing card deck and the computer generated visualization of the roll which is controlled by the playing card ejected by the shuffler, and activation of the display by the shooter using the trackball mouse.

BRIEF DESCRIPTION OF THE DRAWINGS

FIG. 2 is flow chart showing a method of simulating a traditional craps game experience according to a preferred embodiment of the present invention.

DETAILED DESCRIPTION OF THE PREFERRED EMBODIMENT

Figure 1:
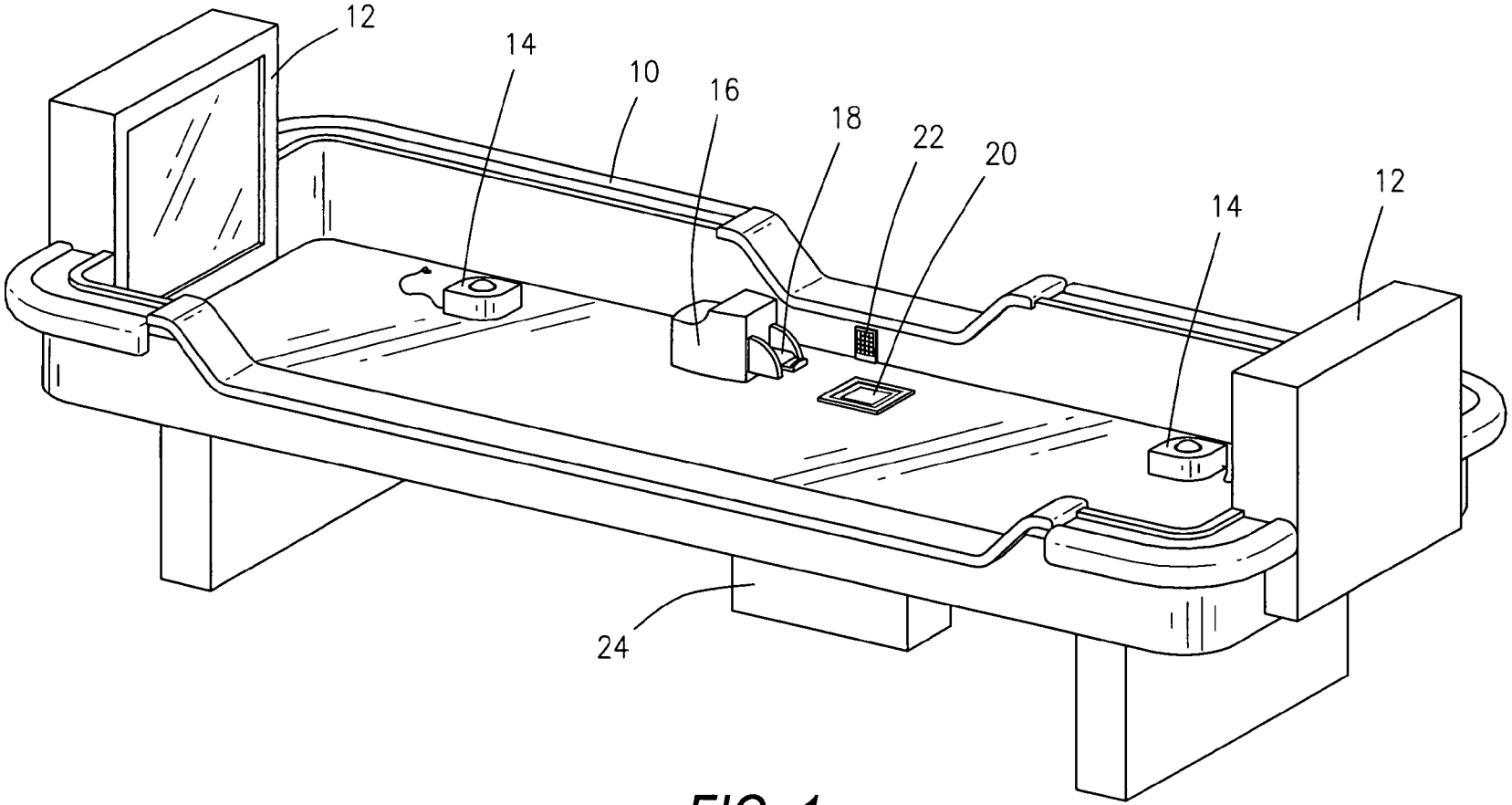
FIG. 1 is perspective view of equipment employed in the present method of simulating a traditional craps game experience including a craps table to which monitors have been added at each end of the table and to which two roller trackballs, a shuffler, a bar code scanner, a keypad and a dedicated computer have been added.

Referring now to the drawings and initially to FIG. 1, there is illustrated equipment used by the present invention. The present invention is a method that provides casino guests with an authentic craps like gaming experience using a standard craps table 10, flat panel LCD or plasma monitors 12 provided at either end of the craps table 10, two trackball mice 14, a card shuffler 16, a specially designed deck of thirty six (36) cards 18 (only one drawn card 18 of the deck is illustrated in FIG. 1), a bar code scanner 20, a keypad 22 and a dedicated computer 24 located under the craps table 10 that is functionally connected to the monitors 12, trackballs mice 14, scanner 20 and keypad 22.

The present method simulates a traditional craps game by using the specially designed deck of thirty six (36) playing cards 18 to determine play rather than rolling dice. The specially designed deck of thirty six (36) playing cards 18 includes one card 18 for each possible roll combination of a pair of dice. Each playing card 18 of the deck has a unique combination of the numbers of the two dice and a barcode containing information about the unique combination of numbers appearing on the card. The cards 18 are randomly shuffled by the shuffler 16 and a card 18 is drawn and scanned via a bar card scanner 20. The barcode information is provided to the computer 24 by the scanner 20 and is then used by the computer 24 to control the matching dice roll displayed on the monitors 12 when a shooter activates a trackball mouse 14. Via the monitors 12, the computer 24 displays an image of a craps table 10 and three dimensional animated rolls of a pair of dice.

Referring now to FIG. 2, the start of the craps game is shown by box 100. At the beginning of play the stickman will press the "0" key on the keypad 22 which tells the computer 24 to display a "Place Your Bets" message and telling the computer 24 to set the comeout flag in the computer's log file to "no". As illustrated in box 102, the monitors 12 then display the image of a craps table 10 with dice readied for a shooter.

Then as shown in box 104, the monitors 12 will display the message "Place Your Bets". The players and shooter will then place their bets in the same manner as done in a traditional craps game. As shown in box 106, the stickman then uses the shuffler 16 to randomly shuffle the deck of cards 18.

If this is a comeout roll, then as shown in boxes 108, and 110, the stickman will press the "*" key on the keypad 22 to set the comeout flag in the computer's file log to "yes". If this were a reset game instead of a comeout roll for the next shooter, then the stickman would not have pressed any keys on the keypad 22 at this time since the computer's comeout log was previously set at "no" when play began at box 100 or, as will be explained more fully hereafter, at box 142.

As shown in box 112, the stickman then draws a top card 18 from the previously randomly shuffled deck by having the shuffler 16 eject the top card 18 face down. As shown by box 114, the stickman passes the drawn card 18 face down over the upwardly facing bar code scanner 20 to scan the card's bar code information in the computer 24 and then the stickman places the card 18 face down on the craps table 10. Meanwhile, as indicated by box 116, the information or record from the card's bar code is written to the computer's log file.

Next, as shown by boxes 118 and 120, the stickman pushes the trackball mouse 14 located on the shooter's end of the craps table 10 to the shooter, if necessary, in preparation for the roll by the shooter and also presses a number key, i.e. one of the keys 1-8, on the keypad 22 to activate the trackball mouse 14 and monitors 12.

As shown in boxes 122 and 124, the shooter then rolls the trackball mouse 14 and the computer 24 deactivates the trackball mouse 14 after the shooter rolls. As shown in box 126, the roll of the trackball mouse 14 activates the computer 24 to display on the monitors 12 a three dimensional image of rolling dice landing on the numbers dictated by the drawn card 18 using the information that was scanned into the computer 24 by the previously drawn card 18.

As a safeguard, as illustrated in box 128, the stickman then turns the drawn card 18 over so that it is then face up to show the card 18 to the players and also calls out dice roll results. In the event that the card dice roll indicia appearing on the card 18 does not match the image displayed by the computer 24 on the monitors 12, the dice roll indicia appearing on the drawn card 18 will always prevail.

Next, as shown in box 130, the dealer collects lost bets and pays winning players. As shown in box 132, if the shooter is not seven out, the play then moves to box 140, which will be discussed hereafter. On the other hand, if the shooter is seven out, then as shown in box 134, the stickman collects the trackball 14 from the shooter and either halts and ends the game as shown in boxes 136 and 138, or alternately, does not halt the game and play then moves to box 140.

Once play moves to box 140, either after the shooter is seven out from box 132 or the stickman does not halt the game after box 136, the stickman places the drawn card back into the deck, and as shown in box 142, presses the "0" key of the keypad to reset the display on the monitors 12 as they appeared at the beginning of the game, as indicated by box 102, and the game is played again. A new deck of cards may be placed in the shuffler at this time, if desired.

All other aspects of the craps game played according to the present method are the same as when playing a traditional craps game using dice including betting, the craps table layout, etc. Like in a traditional craps game, the boxman, stickman, and dealers control all aspects of the game, including betting, card drawing, timing of the shooter simulated dice roll, dropping buy-ins, paying propositions bets, and managing table bank.

The only modification to the traditional craps game made by the present invention is that the rolling of dice is replaced with the random drawing of a card 18 from the specially designed playing card deck and the computer generated visualization of the roll which is controlled by the previously drawn playing card 18. That visualization of the roll appears on the monitors 12 upon activation of the trackball mouse 14 by the shooter, but is completely controlled by the information appearing on the previously drawn card 18.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method of simulating a traditional craps game experience using a specially designed deck of playing cards to determine play rather than rolling dice consisting of the following steps:

a. randomly drawing a single card from a special deck of thirty six cards wherein each of the cards in the deck contains a unique numeric combination of possible numbers that could result from a roll of a pair of dice in a traditional craps game, b. scanning a bar code appearing on the drawn card into a computer wherein said bar code contains computer readable information corresponding to the unique numeric combination contained on the drawn card, c. using the computer to activate a trackball and at least one monitor, d. allowing a shooter to roll the trackball to activate the computer to display on said at least one monitor a visual representation of the numeric combination contained on the drawn card, and e. using the computer to deactivate the trackball after step d.

2. A method according to claim 1 wherein the visual representation of the numeric combination that appears on said at least one monitor is an animated three dimensional image of a pair of dice rolling on a craps table and landing with the dice showing the numeric combination contained on the drawn card.

3. A method according to claim 1 wherein said at least one monitor is also used to display directions to players to Place Your Bets and No More Bets.

4. A method of simulating a traditional craps game experience using a specially designed deck of playing cards to determine play rather than rolling dice consisting of the following steps:

a. pushing a key on a keyboard attached to a computer to cause the computer to display directions on at least one monitor to Place Your Bets, b. randomly shuffling a special deck of thirty six cards wherein each of the cards in the deck contains a unique numeric combination of possible numbers that could result from a roll of a pair of dice in a traditional craps game, c. drawing a single card from the previously randomly shuffled special deck of thirty six cards, d. scanning a bar code appearing on the drawn card into a computer wherein said bar code contains computer readable information corresponding to the numeric combination contained on the drawn card, e. pushing a key on the keyboard to activate a trackball mouse, f. using said at least one monitor to display directions to players of No More Bets, g. allowing a shooter to roll said trackball mouse, h. using the computer to deactivate the trackball after the roll, i. using said trackball roll to activate the computer to display a visual representation on said at least one monitor of the numeric combination contained on the drawn card in the form of an animated three dimensional image of a pair of dice rolling on a craps table and landing so that the dice show the numeric combination contained on the drawn card, j. replacing the drawn card in the deck of cards, and k. repeating steps a-j to play a craps game where steps a-j substitute for a roll of dice in a traditional craps game.

* * * * *